United States Patent [19]

Kasai

[11] Patent Number: 4,866,819

[45] Date of Patent: Sep. 19, 1989

[54] BUCKLE ASSEMBLY

[75] Inventor: Kazumi Kasai, Namerikawa, Japan

[73] Assignee: Yoshida Kogyo K. K., Tokyo, Japan

[21] Appl. No.: 251,358

[22] Filed: Sep. 30, 1988

[30] Foreign Application Priority Data

Sep. 30, 1987 [JP] Japan ..... 62-149666[U]

[51] Int. Cl.[4] ..... A44B 11/26

[52] U.S. Cl. ..... 24/614; 24/625; 24/633

[58] Field of Search ..... 24/614, 615, 671, 672, 24/662, 633, 665, 625, 323, 324, 312, 313

[56] References Cited

U.S. PATENT DOCUMENTS

| | | | |
|---|---|---|---|
| 1,361,645 | 12/1920 | Tonchin | 24/625 |
| 1,701,979 | 2/1929 | Chaunard . | |
| 4,035,877 | 7/1977 | Brownson . | |
| 4,425,689 | 1/1984 | Fildan . | |
| 4,727,630 | 3/1988 | Alan | 24/633 |

FOREIGN PATENT DOCUMENTS

| | | | |
|---|---|---|---|
| 02556398 | 2/1988 | European Pat. Off. . | |
| 2346586 | 3/1976 | France . | |
| 59-72911 | 5/1984 | Japan . | |
| 59-72912 | 5/1984 | Japan . | |
| 2150632 | 7/1985 | United Kingdom | 24/633 |

*Primary Examiner*—James R. Brittain

*Attorney, Agent, or Firm*—Hill, Van Santen, Steadman & Simpson

[57] ABSTRACT

A buckle assembly includes a socket member and a plug member adapted to be releasably coupled with the socket member. The socket member includes a resilient locking arm releasable engageable with a pair of locking legs of the plug member when the locking legs are inserted into the socket member. The plug member includes a resilient tongue disposed between the locking legs and lying in a plane extending above the locking legs. The socket member includes a resilient flap disposed above the locking arm and having on its inner surface a presser lug engageable with the resilient tongue to flex the latter downwardly, and a releasing lug engageable with the locking arm to flex the latter downwardly for disengaging the latter from the locking legs. Upon this disengagement, the resilient tongue flips resiliently upwardly back to its initial flat position, in which instance a beveled upper surface of the resilient tongue slides up a rounded edge of the presser lug, affording a moment to urge the plug member to spring out from the socket member.

17 Claims, 4 Drawing Sheets

BUCKLE ASSEMBLY

BACKGROUND OF THE INVENTION

1. Field of the Invention:

This invention relates to a buckle assembly for releasably connecting belts, straps or the like on garments, bags, water bottles, etc.

2. Description of the Prior Art:

Japanese Utility Model Laid-open Publication No. 59-72912 discloses a buckle assembly including a male member which is plunged out from a guide channel in a female member when the male and female members are disengaged from one another. The male member includes a pair of resilient locking legs releasably engageable with locking corners on a triangular retaining projection disposed in the guide channel of the female member to couple the male and female member. To uncouple the male and female members, a resilient flap of an upper wing of the female member is depressed into the guide channel until a presser head on the resilient flap spreads the resilient locking legs apart against the resiliency thereof to disengage the locking legs from the locking corners of the retaining projection. Upon disengagement, the locking legs contract or spring back laterally inwardly by the resiliency thereof, sliding along forwardly converging opposite side walls of the triangular retaining projection with the result that the male member is plunged out from the guide channel of the female member.

The resilient locking legs of the disclosed buckle assembly double in function as a locking means to interlock the male member and the female member and a thrusting means for plunging out the male member from the female member. The locking force of the locking legs increases as the thickness of the locking legs is increased. The thick locking legs are however resistant to bending forces and hence a large effort is necessary when the locking legs are spread to spring out the male member from the female member. Conversely, the thinner the resilient locking legs, the smaller the pressure on the resilient flap which is required to spread apart the locking legs to plunge out the male member. The thin locking members however provide only a limited locking force which is insufficient to keep the interlocking engagement between the locking member and the retaining projection; the thin locking members are likely to be damaged or broken when subjected to severe pulling forces tending to separate the male and female members.

SUMMARY OF THE INVENTION

With the foregoing difficulties in review, it is accordingly an object of the present invention to provide a buckle assembly incorporating structural features which enable a firm coupling of male and female members when they are assembled together and also enables a reliable plunging-out of the male member from a guide channel in the female member when the male and female member are uncoupled.

According to the present invention, there is provided a buckle assembly including a socket member and a plug member adapted to be releasably coupled with the socket member to connect opposite ends of a belt or strap. The plug member includes a base, a pair of resilient locking legs extending from the base in a common direction, and a resilient tongue disposed between the locking legs and extending from the base in a plane lying above the locking legs. The socket member includes a hollow socket body having a guide chamber defined by and between an upper wing and an intermediate wall of the socket body for receiving therein the locking legs and the resilient tongue. The upper wing has a first slot communicating with the guide chamber to form a cantilevered resilient flap. The intermediate wall has a second slot communicating with the guide chamber to form a cantilevered resilient locking arm releasably engageable with the locking legs to couple the plug and socket members. The resilient flap has in its inner surface a presser lug engageable with the resilient tongue to flex the latter resiliently away from the upper wing and a releasing lug projecting into the guide chamber beyond the presser lug and engageable with the resilient locking arm to flex the latter resiliently away from the upper wing for disengaging the locking arm from the locking legs. One of the presser lug and the resilient tongue has a beveled surface sloping downwardly toward distal ends of the locking legs.

Many other advantages and features of the present invention will become manifest to those versed in the art upon making reference to the detailed description and the accompanying sheets of drawings in which a preferred structural embodiment incorporating the principles of the present invention is shown by way of example.

DETAILED DESCRIPTION

Figure 1:
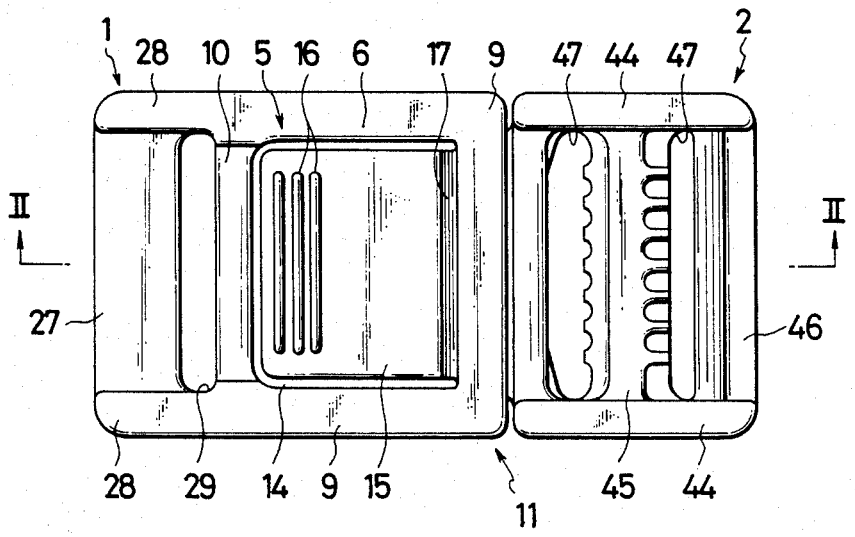
FIG. 1 is a plan view of a buckle assembly according to the present invention.
Figure 2:
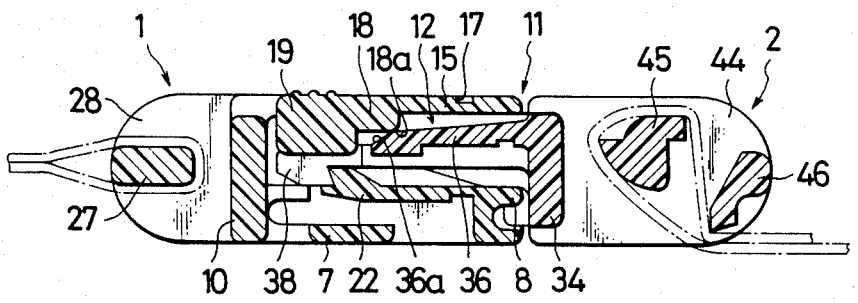
FIG. 2 is a cross-sectional view taken along line II—II of FIG. 1.
Figure 3:
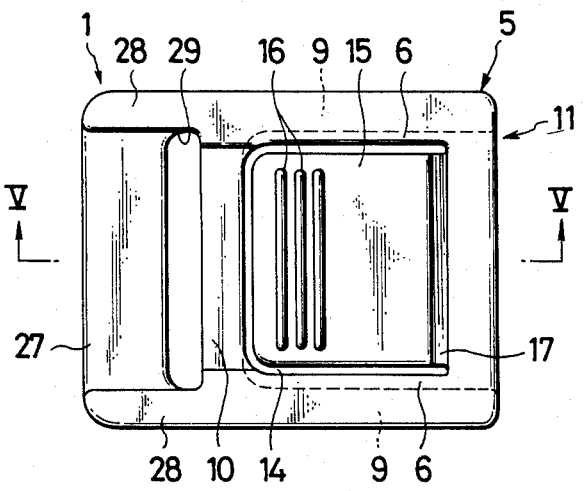
FIG. 3 is a plan view of a female or socket member of the buckle assembly.

FIGS. 1 and 2 show a buckle assembly according to the present invention. the buckle assembly is composed of a female or socket member 1 and a male or plug member 2 releasably coupled with the socket member 1. The socket and plug members 1, 2 are molded of a synthetic resin.

As shown in FIGS. 3 through 6, the socket member 1 includes a generally rectangular box-like hollow body 5 composed of upper and lower wings 6, 7, a horizontal intermediate wall 8 disposed between the upper and lower wings 6, 7, a pair of opposed side walls 9, 9 interconnecting the upper and lower wings 6, 7, and a rear end wall 10 closing a rear end of the hollow socket body 5, the front end 11 of the socket body 5 being open. The socket body 5 has a guide chamber 12 defined between the upper wind 6 and the intermediate wall 8 for receiving a part of the plug member 2 to couple the socket and plug members 1, 2 together, as described later on.

The upper wing 6 has a U-shaped cut-away groove or slit 14 to provide a cantilevered resilient flap 15 capable of flexing about its fixed proximal end located adjacent to the front or open end 11 of the socket body 5. The resilient flap 15 has on its outer surface a plurality of parallel spaced transverse ridges 16 to provide a firm grip when the resilient flap 15 is depressed by the user's finger into the guide chamber 12, and a transverse groove or recess 17 located adjacent to the open end 11 of the socket body 5 for facilitating resilient deformation of the resilient flap 15 toward the intermediate wall 8.

Figure 4:
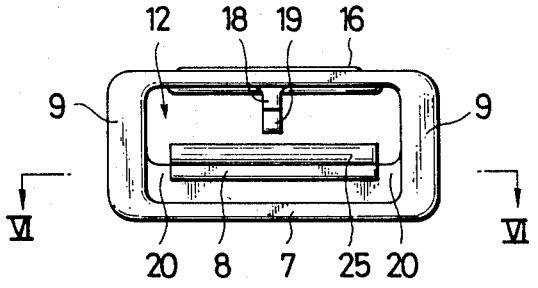
FIG. 4 is a right side view of FIG. 3.

The resilient flap 15 further includes a presser lug 18 and a releasing lug 19 formed integrally with and disposed on the inner surface of the resilient flap 15 adjacent to the distal end of the resilient flap 15. The presser and resilient lugs 18, 19 have the same width and are located centrally between opposite side edges of the resilient flap 15, as shown in FIG. 4. As shown in FIG. 4, the presser and releasing lugs 18, 19 extend parallel to the side walls 9 and project inwardly toward the intermediate wall 8. The presser lug 18 is disposed at a proximal side of the releasing lug 19 and has a rounded front edge 18*a* confronting the open end 11 of the socket body 5 for pressure engagement with a resilient tongue later described, of the plug member 2. The releasing lug 19 projects inwardly beyond the presser lug 18 and terminates short of the intermediate wall 8 for pressure engagement with locking lugs later described, on the plug member 2.

The intermediate wall 8 extends parallel to the upper and lower wings 6, 7 and is joined with the side walls 9, 9 at one end thereof adjacent to the open end 11 of the socket body 5. The intermediate wall 8 is further joined with the lower wing 7 near the open end 11 of the socket body 5 so as to increase the joint strength relative to the socket body 5. The intermediate wall 8 is recessed at opposite sides thereof such that there are two guide recesses 20, 20 defined between the intermediate wall 8 and the opposite side wall 9, 9 and opening forwardly outwardly at the open end 11 of the socket body 5. The intermediate wall 8 has a generally H-shaped cut-away groove or slit 21 (FIG. 6) to divide the intermediate wall 8 into a resilient locking arm 22 and a retaining strip 23 confronting one another. The locking arm 22 and the retaining strip 23 thus provided have substantially the same width as the resilient flap 15.

Figure 5:
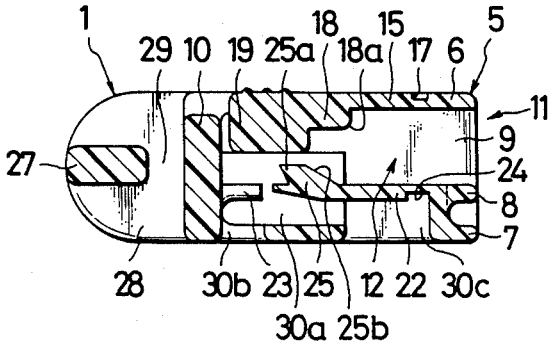
FIG. 5 is a cross-sectional view taken along line V—V of FIG. 3.

The resilient locking arm 22 is shorter than the resilient flap 15 and resiliently deformable about its proximal end adjacent to the open end 11 of the socket body 5. Likewise the resilient flap 15, the locking arm 22 has in its lower surface a transverse groove or recess 24 located adjacent to the proximal end of the locking arm 22 so as to facilitate flexing of the locking arm 22 in a direction toward the lower wing 7. The resilient locking arm 22 further has a locking projection 25 formed integrally with and disposed on an upper surface of the locking arm 22 adjacent to the distal end of the locking arm 22 so as to project upwardly toward the upper wing 6. The locking projection 25 extends throughout the width of the locking arm 22 and is normally held in confrontation with the releasing lug 19 on the resilient flap 15. The locking projection 25, as shown in FIG. 5, includes a canted retaining surface 25*a* at the rear end thereof facing toward the rear end wall 10 of the socket body 5 for interlocking engagement with the locking lugs on the plug member 2, and a sloped guide surface 25*b* at front end thereof facing toward the open end 11 of the socket body 5 for assisting smooth insertion of the plug member 2 into the guide chamber 12. The retaining strip 23 serves to support thereon locking lugs on the plug member 2 in a manner hereafter described when the locking lugs are locked with the resilient locking arm 22. The retaining strip 23 has a central cut-away notch 26 (FIG. 6) formed in registry with the releasing lug 19 on the resilient flap 15. The notch 26 has a width greater than the width of the releasing lug 19 and hence is receptive of the releasing lug 19 when the resilient flap 19 is forced into the guide chamber 12.

The intermediate wall 8 is disposed closer to the lower wing 7 than to the upper wing 6. The lower wing 7 is engageable with a lower surface of the distal end of the resilient locking arm 22 to limit the movement of the locking arm 22 when the locking arm 22 is flexed toward the lower wing 7, thus preventing the resilient locking arm 22 from being damaged or broken during uncoupling operation of the buckle assembly.

The rear end wall 10 is recessed in its upper surface along a central portion coextending with the width of the resilient flap 15, so that an upper surface of the rear end wall 10 lies in a place extending below the general plane of the resilient flap 15. This recessed rear end wall 10 enables an easy maniplulation of the buckle assembly when the user intends to depress the resilient flap 15 with its finger overlying the rear end wall 10.

The socket member 1 includes a transverse crossbar 27 for connection with one end of a belt indicated by phantom lines in FIG. 2. The crossbar 27 is connected at its opposite ends with a pair of opposed side plates 28, 28 extending outwardly from rear ends of the side walls 9, 9, respectively, and extends parallel to the rear end wall 10 with a transverse slot 29 defined therebetween for the passage of the belt.

Figure 6:
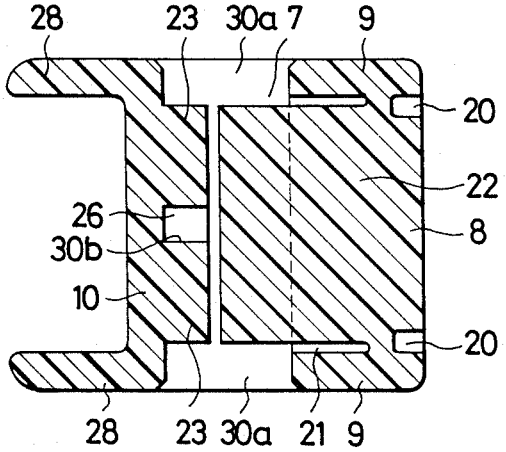
FIG. 6 is a cross-sectional view taken along line VI—VI of FIG. 4.

As shown in FIGS. 5 and 6, the side walls 9, 9 are recessed as at 30*a*, 30*a*. These recesses 30*a* have been formed by a pair of opposed lateral sliding cores of a mold assembly (neither shown) used for the formation of the distal end of the locking arm 22 and the H-shaped slit 21 when the socket member 1 has been molded on the mold assembly. Likewise, an opening 30*b* defined in the lower wing 7 adjacent to the rear end wall 10 has been formed by a vertical sliding core, not shown, used for the formation of the notch 26 in the retaining strip 23. The lower wing 7 further has an opening 30*c* adjacent to the open end 11 which has been formed by another vertical sliding core simultaneously with the molding of the socket member 1.

Figure 7:
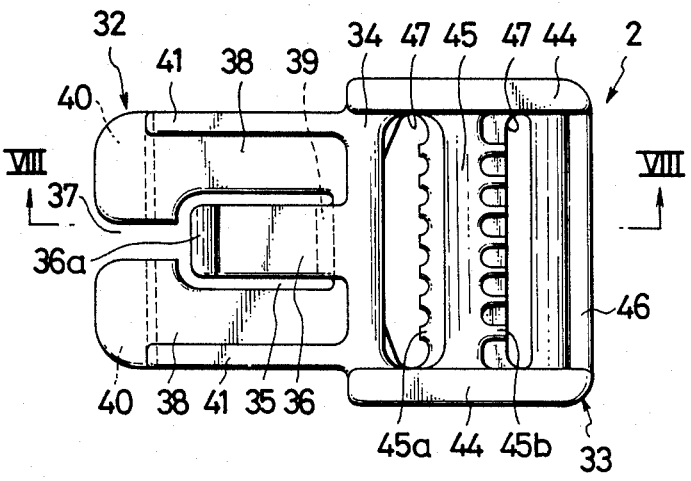
FIG. 7 is a plan view of a male or plug member of the buckle assembly.
Figure 8:
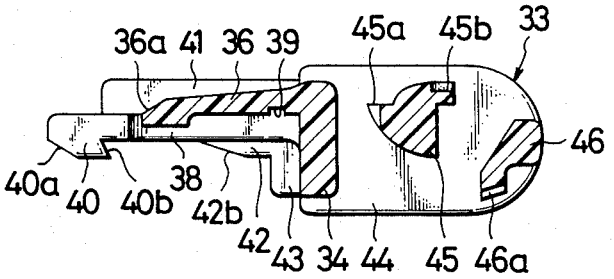
FIG. 8 is a cross-sectional view taken along line VIII—VIII of FIG. 7.

The plug member 2, as shown in FIGS. 7 and 8, includes a thin plate portion 32 detachably receivable in the guide chamber 12 in the socket member 1, and a thick stem portion 33 integral with the plate portion and adapted to be connected with the other end of the belt. The thin plate portion 32 extends from a transverse base 34 of the stem portion 33 and has a width which is the same as the width of the intermediate wall 8. The plate portion 32 has a generally U-shaped slit 35 to provide a resilient tongue 36 capable of flexing downwardly about its fixed proximal end adjacent to the base 34 of the stem portion 33. The plate portion 32 has a central longitudinal groove 37 extending from the distal end toward the proximal end of the plate portion 32 and communicating with the U-shaped slit 35 at the bottom of the latter, so that there is provided a pair of parallel spaced resilient locking legs 38, 38 engageable with the locking arm 22 of the socket member 1. Thus, the resilient tongue 36 and the resilient locking legs 38 extends outwadly from the base 34 in a common direction.

The central groove 37 in the plate portion 32 has the same width as the notch 26 in the retaining strip 23 of the socket member 1 for receiving therein the releasing lug 19 when the resilient locking legs 38 is released from the resilient locking arm 22 to uncouple the plug and socket members 2, 1.

The resilient tongue 36 is disposed between the locking legs 38, 38 adjacent to an upper end of the base 34 and lies in a plane extending about the locking legs 38, 38. The resilient tongue 36 has a length such that a distal end of the resilient tongue is separated from the releasing lug 19 when the locking legs 38, 38 of the plug member 2 are interlocked with the locking arm 22 of the socket member 1. The resilient tongue 36 has a thickness gradually reducing in a direction from the proximal toward the distal end thereof for easy insertion of the resilient tongue 36 into the guide chamber 12. The distal end of the resilient tongue 36 projects downwardly between the locking legs 38, 38 and includes a beveled upper surface **36*a* gently sloping downwardly toward the distal ends of the locking legs 38, 38 for sliding engagement with the rounded edge 18*a* on the presser lug 18 of the socket member 1. The resilient tongue 36 further has a transverse groove or recess 39 formed in its lower surface adjacent to the proximal end of the resilient tongue 36 for facilitating downward flexing of the resilient tongue 36**.

The resilient locking legs 38, 38 are disposed below the resilient tongue 36 and are longer than the resilient tongue 36. The distal ends of the locking legs 38, 38 are enlarged laterally inwardly so as to provide a large surface area for providing a reliable locking engagement with the resilient locking arm 22 of the socket member 1. Each of the locking legs 38 has a locking lug 40 formed integrally with and disposed on a lower surface of the locking leg 38 at the distal end of the locking leg 38. The locking lug 40, as shown in FIG. 8, has a beveled guide surface **40*a* at the front end thereof sloping gently downwardly, and a canted locking surface 40*b* at the rear end thereof facing toward the proximal end of the locking leg 38. The gently sloping guide surface 40*a* is slidably engageable with the guide surface 25*b* of the resilient locking arm 22 to flex the locking arm 22 downwardly toward the lower wing 7 when the locking legs 38 of the plug member 2 are forced into the guide chamber 26 in the socket member 1. The canted locking surface 40*b* is engageable with the retaining surface 25*a* of the resilient arm 22 when the resilient locking legs 38 of the plug member 2 are fully received in the guide chamber 12 in the socket member 1. Each locking leg 38 is reinforced by a pair of reinforcement ribs 31, 42** disposed on upper and lower sides thereof.

The upper reinforcement rib 41 extends from the proximal end toward the distal end of the locking leg 38 along an outer side edge of the locking leg 38 and terminates short of the distal end of the locking leg 38. The upper reinforcement rib 41 thus constructed is slidably engageable with a corresponding one of the side walls 9 and the inner surface of the resilient flap 15 to ensure that the resilient locking legs 38 are stably inserted in the guide channel 12 when the plug member 2 is coupled with the socket member 1. The lower reinforcement rib 42 extends from the proximal end to an intermediate portion of the locking leg 38 and has a tapering forward end **42*a* for facilitating smooth reception of the locking legs 38 into the guide chamber 12 and also for promoting plunging out of the plug member 2 from the socket member 1. The locking legs 38 thus reinforced with the reinforcement ribs 41, 42 are rigid enough to withstand bending forces tending to flex the locking legs 38 downwardly toward the lower wing 7 of the socket member 1 when coupling the buckle assembly. The locking legs 38 further have a pair of positioning projections 43 (FIG. 8) disposed at their proximal ends and formed integrally with the lower reinforcement rib 42. The positioning projections 43 are snugly receivable in the guide recesses 20 in the intermediate wall 7 (FIG. 6) for preventing wobbling or displacement of the socket member 1 relative to the plug member 2 when they are coupled together. This inter-engagement of the projections 43 and the recesses 20 prohibits the plug member 2 from being inserted into the guide chamber 12 in the socket member 1** with its upside facing downwardly.

The stem portion 33 has a hollow rectangular shape and includes a pair of opposed side plates 44, 44 extending from the base 34 in a common direction away from the locking legs 38, a transverse connecting bar 46 interconnecting the side plates 44 remote from the base 34 and a transverse crossbar 45 extending parallel to and disposed between the base 34 and the connecting bar 46. The stem portion 33 has two transverse slots 47, 47 defined between the base 34 and the crossbar 45 and between the crossbar 45 and the connecting bar 46 for the passage therethrough of the other end of the belt indicated by phantom lines in FIG. 2. The other end of the belt is connected to the stem portion 33 with its portion looped around the crossbar 45 so that the effective length of the belt can be adjusted. The crossbar 45 has a toothed first locking edge **45*a* facing toward the base 34 and a toothed second locking edge 45*b* facing upwardly for firm engagement with the belt to prevent the belt from being loosen when it is tensioned. Likewise, the connecting bar 46 has a downwardly directed toothed locking edge 46*a* (FIG. 8**).

To couple the socket and plug members 1, 2 of the buckle assembly as shown in FIGS. 1 and 2, the resilient tongue 36 and the resilient locking legs 38 of the plug member 2 are inserted into the guide chamber 12 in the socket member 1. This insertion causes the resilient locking arm 22 to flex downwardly toward the lower wing 7 as the locking lugs 40 of the locking legs 38 slide frictionally along the locking projection 25 on the resilient locking arm 22. As the locking lugs 40 are moved past the locking projection 25, the resilient locking arm 22 flips resiliently back to its original flat position and is so retained by interlocking engagement between the retaining surface **25*a* of the locking projection 25 and the locking surfaces 40*b* of the locking lugs 40 so that the plug member 2 is locked in place against accidental release from the socket member 1. In this coupled condition, the locking lugs 40 of the locking legs 38 are vertically spaced a distance from the releasing lug 19 of the resilient flap 15 and the actuating front edge 18*a* of the presser lug 18 is held in contact with the beveled upper surface 36*a* of the resilient tongue 36**.

When releasing or uncoupling the plug member 2 from the socket member 1, this is done by pressing the resilient flap 15 of the socket member 1 inwardly into the guide chamber 12. As the resilient flap 15 is flexed, the presser lug 18 forces the resilient tongue 36 to bend resiliently downwardly toward the locking arm 22 beyond the locking legs 38, then the releasing lug 19 moves downwardly through the groove 37 between the locking legs 38 into abutment with the locking projection 25 of the resilient locking arm 22. A further inward flexing of the resilient flap 15 causes the releasing lug 19 to project into the notch 26 in the retaining strip 23, during which time the resilient locking arm 33 is flexed resiliently toward the lower wing 7. With this flexing of the locking arm 22, the locking projection 25 on the locking arm 22 is brought out of interlocking engagement with the locking lugs 40 of the locking legs 38, thus disengaging the locking legs 38 from the locking arm 22. Upon this disengagement, the beveled upper surface 36*a* of the resilient tongue 36 slides upwardly rearwardly along the actuating front edge 18*a* of the presser lug 18 as the downwardly flexed resilient tongue 36 flips resiliently back to its initial flat position, affording a moment to urge the plug member 2 to spring out, thus releasing the same with utmost ease.

As described above, the locking legs 38 of the plug member 2 serves solely as a locking means for connecting the plug and socket members 2, 1 while a thrusting means for urging the plug member 2 to plug out from the socket member 1 is constituted by the resilient tongue 36. With this construction, it is possible to increase the thickness of the resilient locking arm 22 including the locking projection 25 and the resilient locking legs 38 including the locking lugs 40, thereby providing a firm coupling between the socket and plug member 1, 2 without affecting the capability of plunging out the plug member 2 from the socket member 1. The resilient tongue 36 of the plug member 2 is flexed resiliently downwardly by the presser lug 18 of the socket member 1 until the resilient locking arm 22 is released from the resilient locking legs 38 whereupon the resilient tongue 36 flips resiliently upwardly back to its initial position. In this instance, the resilient tongue slides upwardly and rearwardly of the presser lug 18, affording a thrusting force tending to urge the plug member 2 to spring out from the socket member 1. Thus, the socket and plug members 1, 2 are detatched reliably with utmost ease.

Although in the illustrated embodiment the resilient tongue 36 is provided with the beveled upper surface 36*a* slidably engageable with the actuating edge 18*a* of the presser lug 18, it is possible to replace the resilient tongue 36 with another resilient tongue having a rounded edge, in which instance the front edge of the presser lug 18 is beveled to provide a sloped surface slidably engageable with the rounded edge of the resilient tongue.

Obviously, various modifications and variations of the present invention are possible in the light of the above teaching. It is therefore to be understood that within the scope of the appended claims the invention may be practiced otherwise than as specifically described.

What is claimed is:

1. A buckle assembly comprising:

(a) a plug member including a base, a pair of resilient locking legs extending from said base in a common direction, and a resilient tongue disposed between said locking legs and extending from said base in a plane lying above said locking legs; and (b) a socket member adapted to be releasably coupled with said plug member and including a hollow socket body having a guide chamber defined by and between an upper wing and an intermediate wall of said socket body for receiving therein said locking legs and said resilient tongue, said upper wing having a first slit communicating with said guide chamber to form a cantilevered resilient flap, said intermediate wall having a second slit communicating with said guide chamber to form a cantilevered resilient locking arm releasably engageable with said locking legs to couple said plug and socket members, said resilient flap having in its inner surface a presser lug engageable with said resilient tongue to flex said resilient tongue resiliently away from said upper wing and a releasing lug projecting into the guide chamber beyond said presser lug and engageable with said resilient locking arm to flex said resilient locking arm resiliently away from said upper wing for disengaging said locking arm from said locking legs, one of said presser lug and said resilient tongue having a beveled surface sloping downwardly toward distal ends of said locking legs.

2. A buckle assembly according to claim 1, said first slit having a U-shape.

3. A buckle assembly according to claim 1, said socket body further having an end wall joined with said upper wing and said intermediate wall to close one end of said guide chamber, said cantilevered resilient flap having a fixed end disposed adjacent to an open end of said guide chamber, said cantilevered resilient locking arm having a fixed end disposed adjacent to said open end of said guide chamber.

4. A buckle assembly according to claim 3, said end wall having an upper wall lying in a plane extending below said upper wing.

5. A buckle assembly according to claim 1, said resilient flap having on its outer surface a plurality of transverse ridges.

6. A buckle assembly according to claim 1, said cantilevered resilient flap having in its outer surface a transverse recess disposed adjacent to a fixed end of said cantilevered resilient flap.

7. A buckle assembly according to claim 1, said presser and releasing lugs being integral with each other, and said releasing lug being movable between said pair of locking legs.

8. A buckle assembly according to claim 1, said second slit in said intermediate wall extending transversely through said intermediate wall to form said cantilevered resilient locking arm and a retaining strip confronting said locking arm, said retaining strip being engageable with said locking legs for holding the latter thereon and having a notch for the passage of said releasing lug of said resilient flap.

9. A buckle assembly according to claim 1, said cantilevered resilient locking arm having in its outer surface a transverse recess disposed adjacent to a fixed end of said cantilevered resilient locking arm and opening away from said guide chamber.

10. A buckle assembly according to claim 1, said socket body further including a lower wing extending parallel to said upper wing and spaced from said intermediate wall in a direction away from said upper wing, said lower wing being engageable with said resilient locking arm to limit the resilient deformation of said locking arm.

11. A buckle assembly according to claim 1, said resilient tongue having in its lower surface a transverse recess disposed adjacent to said base.

12. A buckle assembly according to claim 1, said resilient tongue having a thickness gradually reducing from a fixed proximal end toward a distal end thereof.

13. A buckle assembly according to claim 1, said beveled surface being formed on an upper surface of said resilient tongue at a distal end thereof, said presser lug of said resilient flap having a rounded edge engageable with said beveled upper surface of said resilient tongue.

14. A buckle assembly according to claim 1, each of said locking legs having upper and lower reinforcement ribs disposed on upper and lower surfaces of said locking legs and extending from said base toward a distal end of each of said locking legs.

15. A buckle assembly according to claim 14, said upper reinforcement rib terminating short of said distal end of said locking leg and slidably engageable with said inner surface of said resilient flap, said lower reinforcement rib terminating in a tapering forward end disposed at an intermediate portion of said locking leg and slidably engageable with one surface of said locking arm facing said guide chamber.

16. A buckle assembly according to claim 1, said intermediate wall having a pair of laterally spaced guide recesses opening outwardly at an open end of said socket body, said plug member having a pair of positioning projections snugly receivable in said guide recesses, respectively.

17. A buckle assembly according to claim 1, said socket and plug members being molded of synthetic resin.

* * * * *